US005283407A

United States Patent [19]

Pohl

[11] Patent Number: 5,283,407

[45] Date of Patent: Feb. 1, 1994

[54] ARTICULATED PUSHBUTTON ELECTRICAL SWITCHING APPARATUS

[75] Inventor: Randy P. Pohl, Brookfield, Wis.

[73] Assignee: Allen-Bradley Company, Inc., Milwaukee, Wis.

[21] Appl. No.: 845,071

[22] Filed: Mar. 3, 1992

[51] Int. Cl.[5] ..... H01H 21/24

[52] U.S. Cl. ..... 200/332; 200/302.3; 200/341; 200/561

[58] Field of Search ..... 200/561, 557, 332, 302.3, 200/339, 341, 344

[56] References Cited

U.S. PATENT DOCUMENTS

| | | | |
|---|---|---|---|
| 2,466,402 | 4/1949 | Falk | 200/561 |
| 2,896,034 | 7/1959 | Nolden et al. | 200/332 |
| 2,981,816 | 4/1961 | Cozart | 200/341 |
| 3,629,535 | 12/1971 | Walters et al. | 200/302.3 |
| 4,367,386 | 1/1983 | Sorenson | 200/339 |

*Primary Examiner*—Renee S. Luebke

*Attorney, Agent, or Firm*—John J. Horn; H. Frederick Hamann

[57] ABSTRACT

A palm operable electrical switching apparatus which is integrally constructed with the cover plate of an electrical junction box. The switching apparatus comprises a padded button assembly which is easily operable from off-center directions, an activator assembly which converts motion transferred from the button assembly to straight line movement suitable for operating an electrical switch such as a contact block and a contact block positioned for actuation by the activator assembly. The switching apparatus enables a higher degree of operational flexibility and greater amount of conformity with human operators.

6 Claims, 3 Drawing Sheets

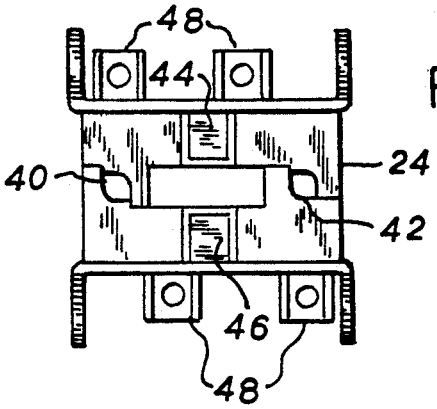
FIG. 3
FIG. 4
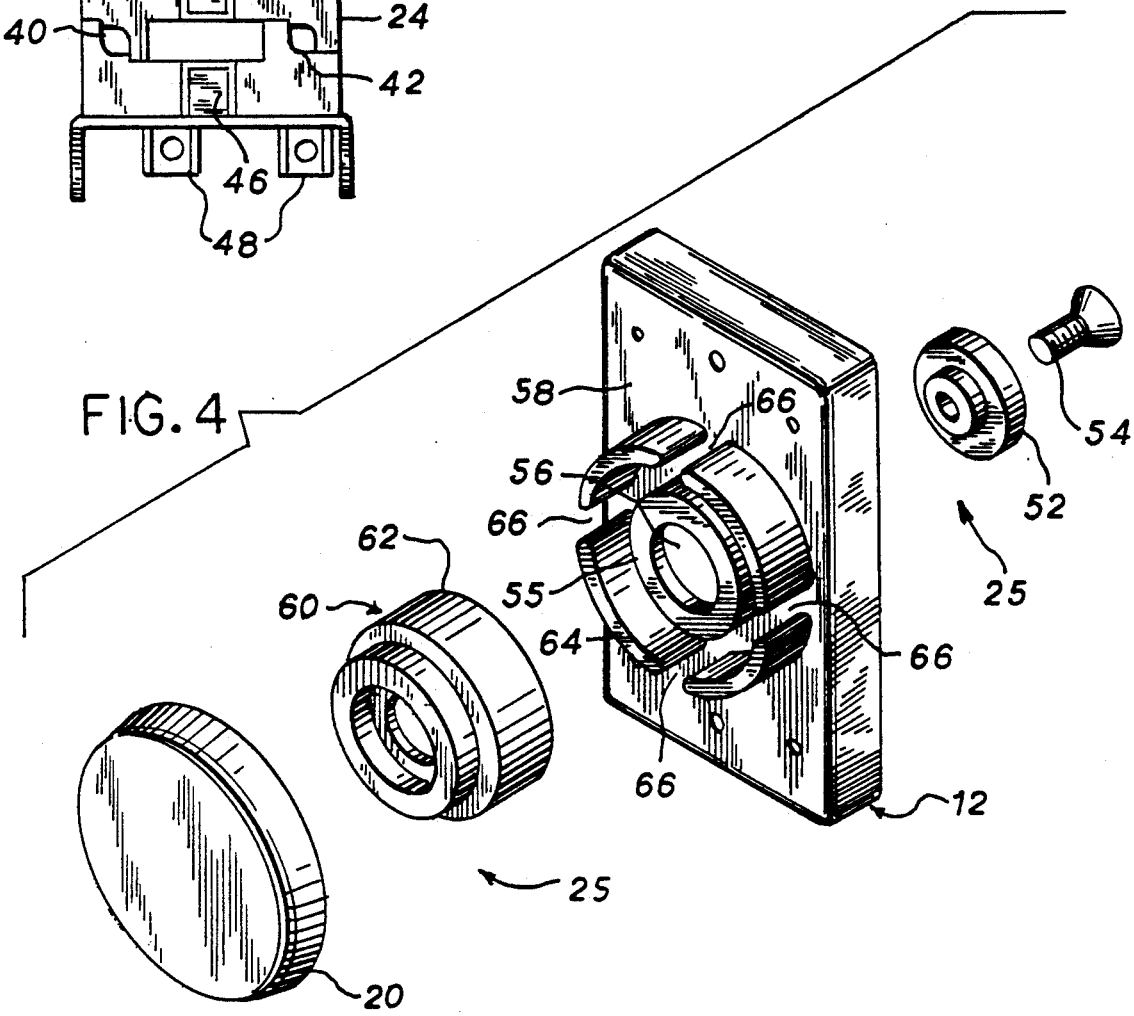
FIG. 5
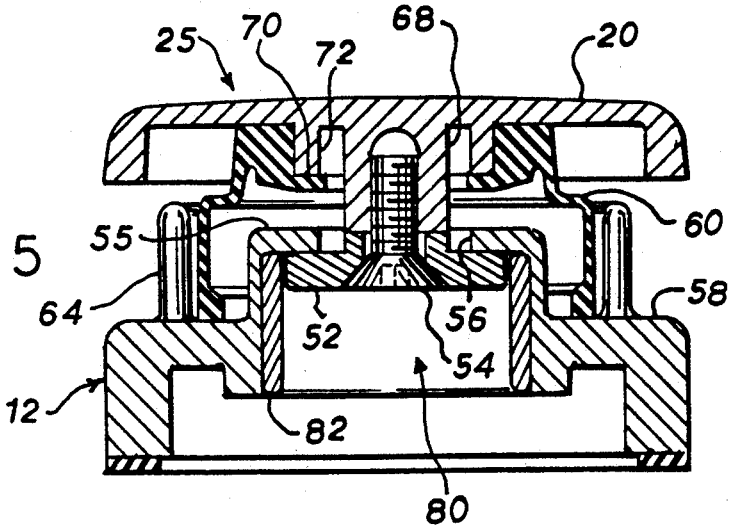

ARTICULATED PUSHBUTTON ELECTRICAL SWITCHING APPARATUS

BACKGROUND OF THE INVENTION

The present invention relates to electrical switches and more particularly to manually operated pushbutton switches.

In the past, electrical pushbutton switches have used straight line linkages between the button and the switch mechanism for making or breaking electrical contact. With this type of linkage, operation of the button from off-center directions requires progressively greater operating forces. The operation of the switch therefore does not conform to different human operators having different physical characteristics and does not enable easy operation of the switch from varying positions or postures. Additionally, some types of pushbutton switches have been designed with shapes which allow small amounts of debris to collect around the button and the shaft on which it is mounted.

It is therefore an object of the present invention to provide an ergonomically designed electrical switching apparatus which is articulated to allow the operation of the apparatus to conform to the human operator and which may be operated from off-center directions with the use of low levels of force.

It is another object of the present invention to provide a electrical pushbutton switching apparatus in which the travel stops and button itself are cushioned to facilitate rapid and comfortable operation of the apparatus by human operators.

It is a further object of the present invention to provide a palm operable electrical switching apparatus which is protected against mechanical interference and contamination by fluids or debris.

SUMMARY OF THE INVENTION

The present invention constitutes a ergonomically designed palm operable electrical switching apparatus configured for mounting on an electrical junction box. The switching apparatus includes a padded button assembly which may be operated by low levels of force from off-center directions, an activator assembly which converts motion by the button assembly into unidirectional movement suitable for actuating a contact block and an electrical contact block positioned for being actuated by the activator assembly. The switching apparatus also includes a two-tier sealing mechanism including a boot deployed underneath the button to protect against entry by debris and a diaphragm deployed between the button assembly and activator assembly for providing a fluid seal. In operation, motion is transferred through the button assembly and activator assembly to the contact block with the button assembly providing articulation which serves to conform the operation of the mechanism to the operator and allows easy operation from off-center directions.

In the preferred embodiment, the switching apparatus is integrally constructed with the cover plate for the junction or connector box in which the contact block is deployed. The button assembly includes a tipping plate positioned behind the cover plate. The tipping plate is attached to a large dome shaped button through an aperture in the cover plate and resides in a bore defined by the cover plate. The activator assembly includes an adapter plate for mounting a shaft or push rod having a pressure plate at one end and an operating washer at its other end. The pressure plate is disposed within the same bore as the tipping plate and is subject to being displaced by the tipping plate as the button is pressed thereby also moving the operating washer which activates the contact block. A castellated ridge is provided at a spaced apart position on the cover plate surrounding the aperture to protect against mechanical interference and a flexible boot is captured between the button and the front of the cover plate inward of the castellated ridge for protecting against contamination by debris. A sealing diaphragm is deployed between the activator assembly and cover plate to prevent the entry of fluids into the interior of the junction box.

BRIEF DESCRIPTION OF THE DRAWINGS

FIG. 3 provides a plan view of the back of a contact block showing the structure whereby the contact block may be actuated.

FIG. 4 provides an elevated prospective view from a forward angle of the button assembly of the present invention.

FIG. 5 provides a cross sectional view of the button assembly of the present invention.

DESCRIPTION OF THE PREFERRED EMBODIMENT

Figure 1:
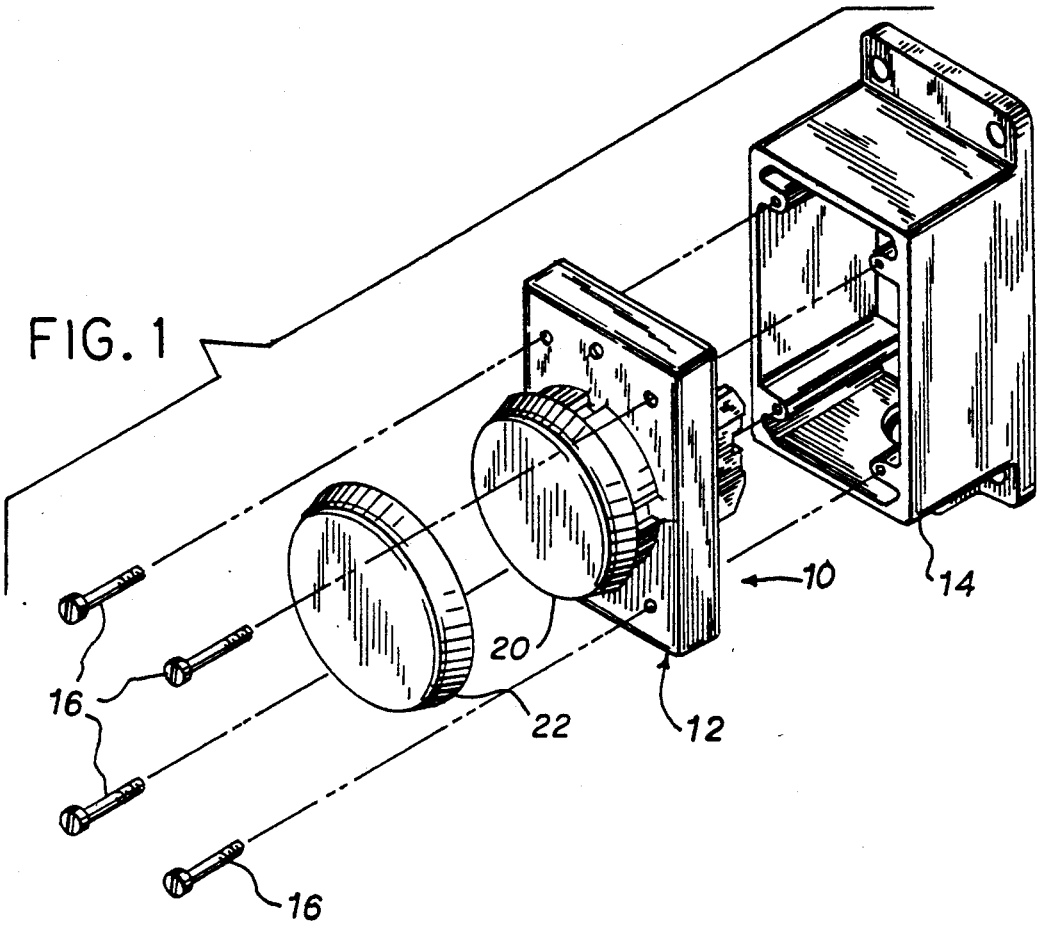
FIG. 1 provides an overall prospective view of the switching apparatus of the present invention, connector box cover plate with which the apparatus is integrally constructed and electrical connector box onto which the apparatus may be mounted.

Referring now to FIG. 1, the present invention comprises a palm operable electrical switching apparatus 10 which is integrally constructed with a cover plate 12 adapted for mounting the switching apparatus 10 onto an electrical junction or connector box 14 through the use of a set of screws 16. The switching apparatus 10 is operated by pressing a dome shaped button 20 disposed on the front of the cover plate 12 which has a resilient cover 22 for cushioning the mechanism against the operator's hand during actuation.

Figure 2:
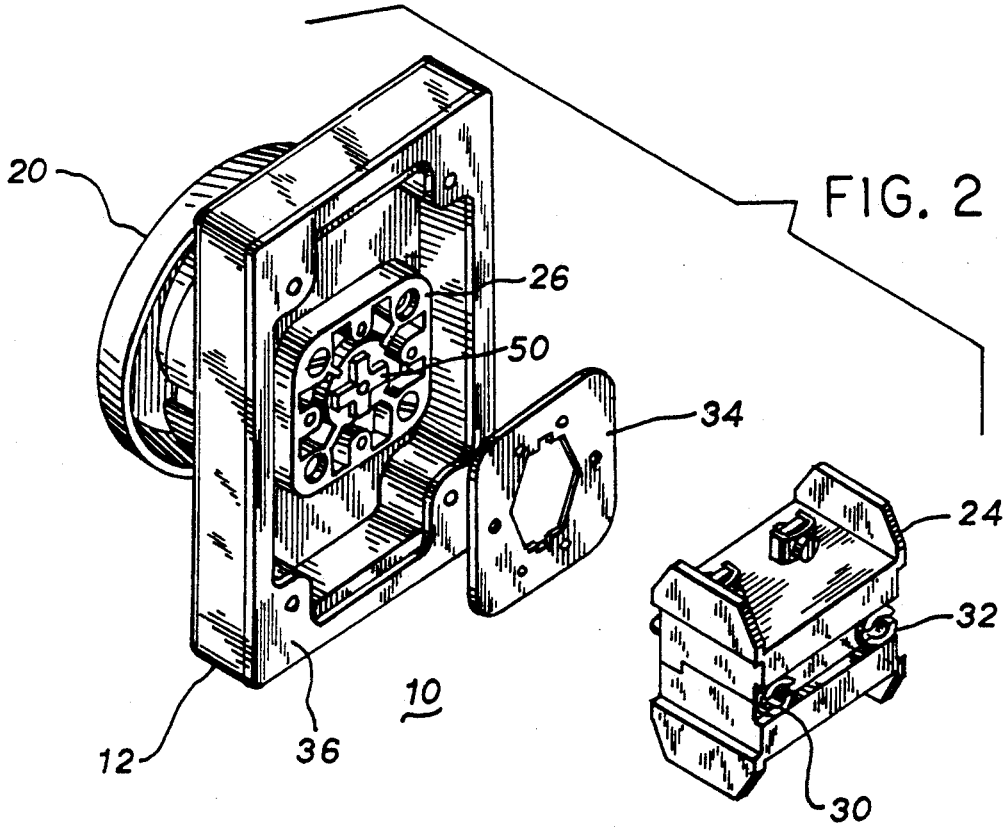
FIG. 2 provides an elevated prospective view from a rearward angle of the switching apparatus of the present invention showing the positioning of the contact block with respect to the activator assembly and the cover plate.

Referring now to FIG. 2, the apparatus 10 also includes a conventional style electrical contact block 24 which is mounted onto an adapter plate 26 secured to the cover plate 12 by a pair of screws 30 and 32. A thin sheet of electrical insulation 34 is deployed between the contact block 24 and adapter plate 26 to help ensure electrical isolation between the contact block 24 and the rest of the switching apparatus 10. It should be noted that the cover plate 12 includes a gasket 36 which is adapted for sealing off the inside of the connector box 14 against the entry of both solid and fluid contaminants which might otherwise interfere with the operation of the switching apparatus 10. As shown in FIG. 3 the contact block 24 includes a pair of passages 40 and 42 for the screws 30 and 32, a pair of spanners 44 and 46 for operating the electrical contacts within the block and a set of connection terminals 48 by which electrical leads can be readily fastened to the contact block 24. The contact block 24 is operated in response to the spanners 44 and 46 being depressed inward below the surface of the block 24 thereby initiating the making and breaking electrical contacts connecting the terminals 48. Referring back again to FIG. 2, when the button 20 is pressed for the purpose of operating the switching apparatus 10, the star shaped operating washer 50 is projected outward from the back of the adapter plate 26 thereby depressing the spanners 44 and 46 and operating the electrical contacts within the contact block 24.

Referring now to FIG. 4, the button assembly 25 includes not only the button 20 which is disposed over the front of the cover plate 12 but also the push or tipping plate 52 which is deployed behind the cover plate 12 and is secured to the button 20 by a machine screw 54. In fastening the plate 52 onto the button 20 the machine screw 54 passes through a centrally positioned aperture 56 in a raised sill 55 on the front 58 of the cover plate 12. When the switching apparatus 10 is assembled, a boot 60 of flexible material is captured between the button 20 and the front 58 of the cover plate 12. A castellated ridge 64 extends upward from the front 58 of the cover plate 12 surrounding the boot 60 at a spaced apart position from the sill 55. The boot 60 serves to help seal off the aperture 56 from entry by debris which might otherwise collect and interfere with the operation of the switching apparatus 10. The boot 60 also helps to urge the button 20 outward from the cover plate 12 and cushion the action of the button 20 as it is pressed inward toward the cover plate 12. The castellated ridge 64 serves to protect the button assembly 25 from mechanical interference while allowing dirt and debris to be washed away from proximity to the aperture 56 through the openings 66.

Referring now to FIG. 5, the button 20 extends over the raised aperture 56 and sill 55 as well as the castellated ridge 64. The tipping plate 52 is secured by the machine screw 54 onto the end of a shaft 68 extending back from the center of the button 20. The boot 60 is captured between the button 20 and the front 58 of the cover plate 12 inward of the castellated ridge 64 and outward of the raised sill 55. The boot 60 includes a ledge 70 which extends inward over the spacing ring 72 and which is functional for cushioning contact between the button 20 and the sill 55. It should be noted that the tipping plate 52 is disposed within the upper part of a cylindrical bore 80 defined by the walls of the cover plate 12 extending downward from the sill 55 and that a bronze bearing 82 is positioned along the inner surface of the bore 80.

Figure 6:
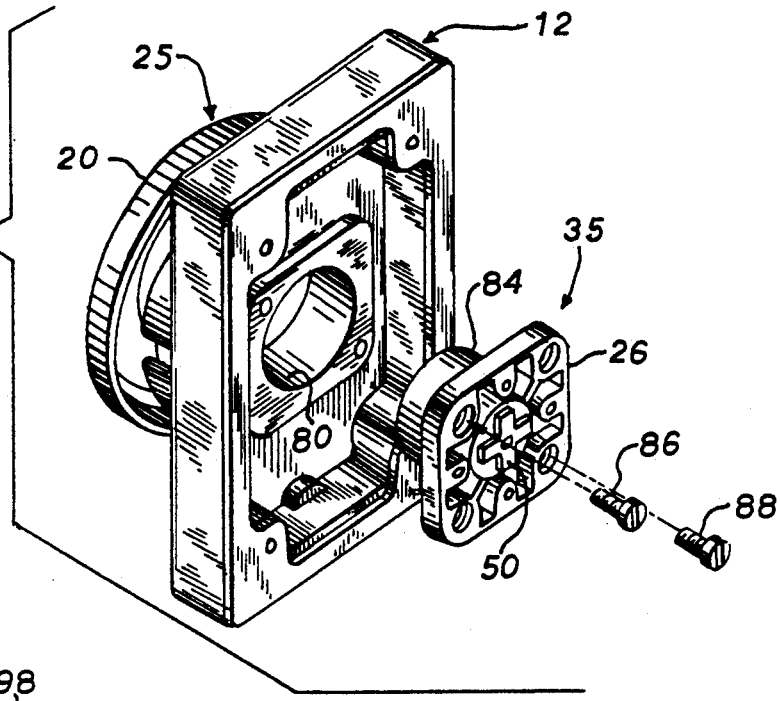
FIG. 6 provides an elevated prospective view from a rearward angle showing the mounting of the activator assembly onto the back of the cover plate.

Referring now to FIG. 6, an activator assembly 35 is shown as including the adapter plate 26 and a pressure plate 84. The activator assembly 35 is attached to the back of the cover plate 12 by two screws 86 and 88 which extend through the adapter plate 26 and seat into the back of the cover plate. When secured in position the activator assembly 35 and more particularly the pressure plate 84 project into the bore 80 so as to make contact with the tipping plate 52.

Figure 7:
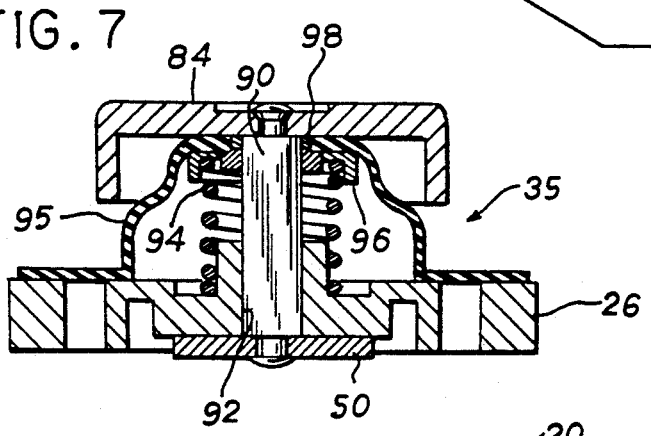
FIG. 7 provides a cross sectional view of the activator assembly of the present invention.

Referring now to FIG. 7, the activator assembly 35 includes a shaft 90 which extends through and is slidably mounted within a bore 92 in the center of the adapter plate 26. The shaft 90 has the pressure plate 84 riveted at its top end and the operating washer 50 riveted at its bottom end. The pressure plate 84 is designed to fit snugly in the bore 80 against the bearing 82 and operate in a piston-like fashion sliding straight up and down without substantial friction. The pressure plate 84 is urged outward from the adapter plate 26 by a coil spring 94 disposed around the shaft 90. The coil spring 94 extends between the adapter plate 26 and a cup washer 96. The cup washer 96 extends around a spacer 98 encompassing the top of the shaft 90 at the juncture of the shaft 90 and the pressure plate 84. The activator assembly 35 also includes a thin diaphragm 95 of flexible material extending radially outward and downward from the top of the shaft 90 to the outer edge of the adapter plate 26. The diaphragm 95 is held in place against the pressure plate 84 by the cup washer 96 pursuant to the action of the spring 94 pressing against the washer. The diaphragm 95 serves to seal the interior of the connector box 14 against the entry by fluids.

Figure 8:
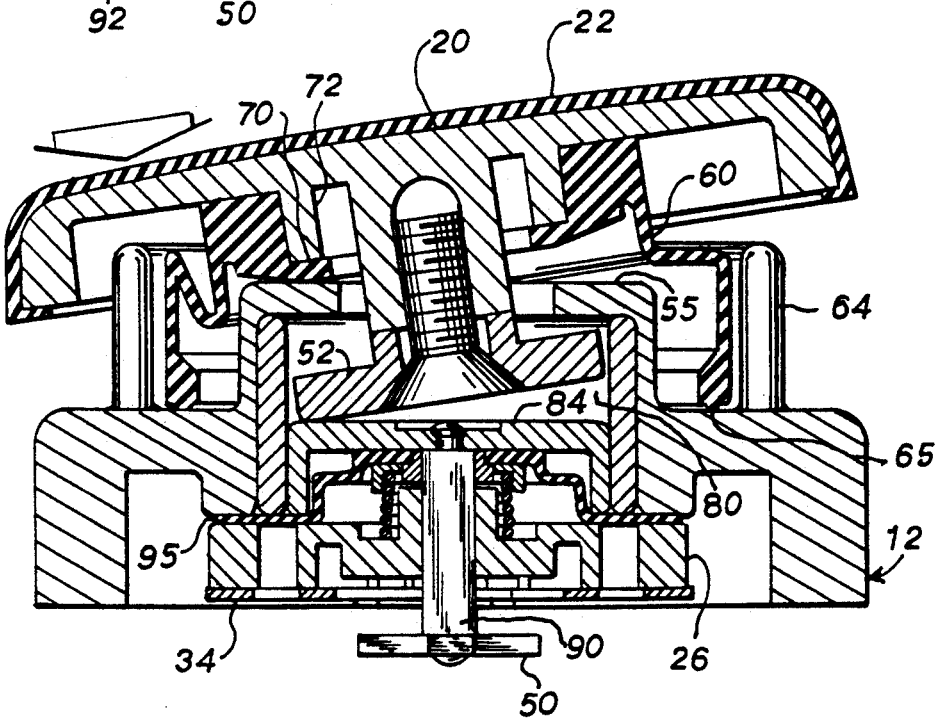
FIG. 8 provides a cross sectional view of the button assembly and activator assembly of the present invention illustrating the operation of the present invention.

Referring now to FIG. 8, the operation of the switching apparatus 10 is shown as the button 20 is pressed along one side from an off center position and direction. The tipping plate 52 is correspondingly displaced from its normal position resting against the backside of the sill 55. The plate 52 has in turn pushed the pressure plate 84 straight down within the bore 80 thereby also moving the shaft 90 and projecting the star shaped operating washer 50 outward from the bottom of the adapter plate 26 and actuating the contact block 24 (not shown in FIG. 8).

The actions of the pushbutton assembly and the activator assembly should be carefully noted. The pushbutton assembly may be actuated from different directions off-center with respect to the button 20 itself. The interaction between the tipping plate 52 and pressure plate 84 converts any off-center action of the push button assembly into straight line or "unidirectional" movement orthogonal to the adapter plate 26. The shaft 90 acts as a "push rod" directing motion from the button 20, tipping plate 52 and pressure plate 84 to the operating washer 50 for actuating the contact block 24.

FIG. 8 also shows a set of protrusions or ribs 65 along the bottom edge of the boot 60 which allow venting of air from between the boot 60 and cover plate 12. This venting helps to pneumatically cushion the action of the button 20 when it is subject to rapid actuation. The cushioning action of the ledge 70 is also illustrated as it is pressed between the spacing ring 72 and the sill 55. Further, FIG. 8 shows the sealing action of the diaphragm 95 as it is sandwiched between the adapter plate 26 and the cover plate 12 at its outer edge and is held against the bottom side of the pressure plate 84 at its inner edge.

While particular embodiments of the present invention have been shown and described, it should be clear that changes and modifications may be made to such embodiments without departing from the true scope and spirit of the invention. It is intended that the appended claims cover all such changes and modifications.

I claim:

1. A pushbutton apparatus for use in actuating an electrical contact block disposed within an electrical connector box including a front, comprising:

(1) a cover plate adapted for being secured onto the front of said electrical connector box;

(2) a palm-operable button assembly including a planar pushbutton positioned in front of and extending over said cover plate which is constructed and arranged for axial actuation and a tipping plate positioned behind said cover plate which is attached to said pushbutton by way of a shaft passing through an oversize aperture in said cover plate which allows for said pushbutton to be operated from axially off-center directions anywhere on said pushbutton;

(3) an activator assembly including a planar adapter plate secured to the back of said cover plate on one side and said contact block on its other side and a push rod passing through a bore in said adapter plate, said push rod including a pressure plate located in contact with said tipping plate of said pushbutton assembly and said contact block so that when said pushbutton is depressed, said push rod is unidirectionally displaced and in turn actuates said contact block;

(4) a flexible boot captured between said pushbutton and said cover plate for shielding said aperture from exposure to debris and urging said pushbutton outward from said cover plate; and (5) a castellated ridge surrounding said boot for protecting said pushbutton from mechanical interference.

2. A pushbutton apparatus for use in actuating an electrical contact block disposed within an electrical connector box including a front, comprising:

(1) a cover plate adapted for being secured onto the front of said electrical connector box;

(2) a palm-operable button assembly including a planar pushbutton positioned in front of and extending over said cover plate which is constructed and arranged for axial actuation and a tipping plate positioned behind said cover plate which is attached to said pushbutton by way of a shaft passing through an oversize aperture in said cover plate which allows for said pushbutton to be operated from axially off-center directions anywhere on said pushbutton;

(3) an activator assembly including a planar adapter plate secured to the back of said cover plate on one side and said contact block on its other side and a push rod passing through a bore in said adapter plate, said push rod including a pressure plate located in contact with said tipping plate of said pushbutton assembly and said contact block so that when said pushbutton is depressed, said push rod is unidirectionally displaced and in turn actuates said contact block; and (4) a sheet of electrical insulation attached between said adapter plate of said activator assembly and said contact block.

3. An electrical pushbutton switch for operating electrical contacts disposed within an electrical connector box including a front having a center, said switch comprising:

a cover plate which is adapted for attachment onto the front of said connector box and which includes an aperture positioned substantially toward the center of the cover plate;

a pushbutton assembly including a pushbutton positioned over said cover plate by being mounted on a shaft extending through said aperture, said pushbutton and shaft operable for activating one or more sets of electrical contacts within said connector box; and a castellated ridge which is spaced apart from but surrounds said aperture for protecting said pushbutton assembly from mechanical interference; and a flexible boot captured between said pushbutton and said cover plate between said ridge and said aperture for shielding said aperture from exposure to debris.

4. The switch of claim 3, wherein said pushbutton assembly includes a resilient cover for cushioning its surface along its area of hand contact.

5. The switch of claim 3, wherein said boot includes ribs along its edge abutting the surface of said cover plate in order to allow air to be vented from between said boot and cover plate.

6. The switch of claim 5, wherein said pushbutton assembly further includes a tipping plate secured to said shaft behind said cover plate and an activator assembly for converting any displacement of said tipping plate to a unidirectional movement for actuating one or more electrical contacts in a contact block.

* * * * *